US006119351A

United States Patent [19]

Vanderputt

[11] Patent Number: 6,119,351

[45] Date of Patent: Sep. 19, 2000

[54] BEVELED EDGE FORK

[76] Inventor: Maurice Vanderputt, 1, 136 - 15 Ave. SE., Calgary AB, Canada, T2G 1G2

[21] Appl. No.: 09/130,903

[22] Filed: Aug. 6, 1998

Related U.S. Application Data

[63] Continuation-in-part of application No. 08/935,288, Sep. 22, 1997, abandoned.

[51] Int. Cl.[7] ..... A47J 43/28

[52] U.S. Cl. ..... 30/322; 30/147; 30/148

[58] Field of Search ..... 30/322, 324, 142, 30/147–50; D7/122

[56] References Cited

U.S. PATENT DOCUMENTS

| | | | |
|---|---|---|---|
| Re. 9,687 | 5/1881 | Cox . | |
| D. 27,820 | 11/1897 | Birtcherd . | |
| D. 31,575 | 10/1899 | Phillips et al. . | |
| D. 93,956 | 11/1934 | Wilson | 30/322 X |
| D. 94,390 | 1/1935 | Phillips | 30/148 X |
| D. 199,630 | 11/1964 | Dedic | 30/150 X |
| 1,294,031 | 2/1919 | Bigelow . | |
| 1,353,090 | 9/1920 | de Teixeira . | |
| 1,699,248 | 1/1929 | Pasal | 30/148 |
| 2,473,288 | 6/1949 | McNeill | 30/147 |
| 4,535,538 | 8/1985 | Nelson | 30/147 |
| 4,771,541 | 9/1988 | Bouchakian | 30/148 |

*Primary Examiner*—M. Rachuba
*Assistant Examiner*—T. Anthony Vaughn
*Attorney, Agent, or Firm*—Sean W. Goodwin

[57] ABSTRACT

A beveled edge fork provides a handle and a head portion. A preferred version of the head provides four tines extending from a base of the head portion, which are strengthened by center, left and right reinforcements. A concave upper surface, enclosed by a U-shaped upper convex perimeter surface mates with a lower beveled edge on a lower convex surface, forming left and right cutting edges, allowing a user to cut food with the side of the fork.

2 Claims, 4 Drawing Sheets

BEVELED EDGE FORK

CROSS-REFERENCES

The present application is a continuation in part of an application having Ser. No. 08/935,288, filed Sep. 22, 1997, now abandoned.

BACKGROUND

Several examples of a combined knife and fork have been known in the prior art U.S. Pat. No. 9,687 reissued May 3, 1881 to A. W. Cox discloses a Combined Knife and Fork providing a head portion having a flat upper surface and a convex lower lower surface. The surfaces intersect to define a sharp edge on the two outer tines. To increase the rigidity of the outer tines, which are stressed due to their use as a cutting blade, the bifurcations or slots between the outer tines and inner tines is less than the depth of the central bifurcation between the inner tines.

U.S. Pat. No. 1,294,031, issued Feb. 11, 1919 to Henry J. Bigelow, discloses a fork having a single outer tine having a sharpened or serrated edge U.S. Pat. No. 4,771,541, issued Sep. 20, 1988, discloses a combination fork and knife having a serrated edge, a tab structure which allows a user to conveniently apply more pressure to the blade. The slot between the outer tine and the tine adjacent to it is not as deep, providing additional strength to the cutting edge.

In view of the above disclosures, there is still a need for an improved combined knife and fork having a more rigid cutting edge, reinforced tines and superior food handling abilities resulting from a fork head having an upper concave surface which also tends to result in a convenient cutting edge.

SUMMARY

The present invention is directed to an apparatus that satisfies the above needs. A novel beveled edge fork is disclosed that provides a structure having more rigid outer tines and therefore more rigid cutting edge and generally superior food-handling abilities.

The beveled edge fork of the present invention provides some or all of the following structural elements.

(A) A handle, sized and shaped in a conventional manner, for manual operation. A curved transition portion of the handle supports a head portion of the fork.

(B) A fork head portion, having an upper surface and a lower surface, the fork head portion additionally providing:

(a) A base, carried by the curved transition portion of handle.

(b) Left and right outer tines, carried by the base.

(c) Left and right inner tines, carried by the base.

(d) A center reinforcement, carried between the left and right inner tines, wherein the center reinforcement, the left and right inner tines and the base define a center slot.

(e) Left and right side reinforcements, carried between the left outer tine and left inner tine and between the right outer tine and right inner tine, respectively, wherein the left and right inner and outer tines and base define left and right side slots.

(f) An upper concave surface, covering a middle portion of the upper surface of the fork head portion.

(g) An upper convex perimeter surface, adjacent to and surrounding the upper concave surface. Left and right side portions of the upper convex perimeter surface define left and right upper beveled edges.

(h) A lower convex surface, opposed to the upper concave surface, defining left and right lower beveled edges about its perimeter.

(i) Left and right curved cutting edges, defined at the intersection of the left and right upper and lower beveled edges, respectively.

It is therefore a primary advantage of the present invention to provide a novel beveled edge fork having reinforcements between adjacent inner and outer tines, and between adjacent inner tines, thereby providing a more rigid support for the cutting edges defined at the intersection of the upper and lower beveled edges on the outer tines.

Another advantage of the present invention is to provide a beveled edge fork having an upper concave surface which allows better food-handling ability.

A still further advantage of the present invention is to provide an upper perimeter convex surface, adjacent to and surrounding the upper concave surface, which forms a cutting edge with the beveled edge of the lower surface.

DRAWINGS

These and other features, aspects, and advantages of the present invention will become better understood with regard to the following description, appended claims, and accompanying drawings where:

DESCRIPTION

Figures 1, 2:
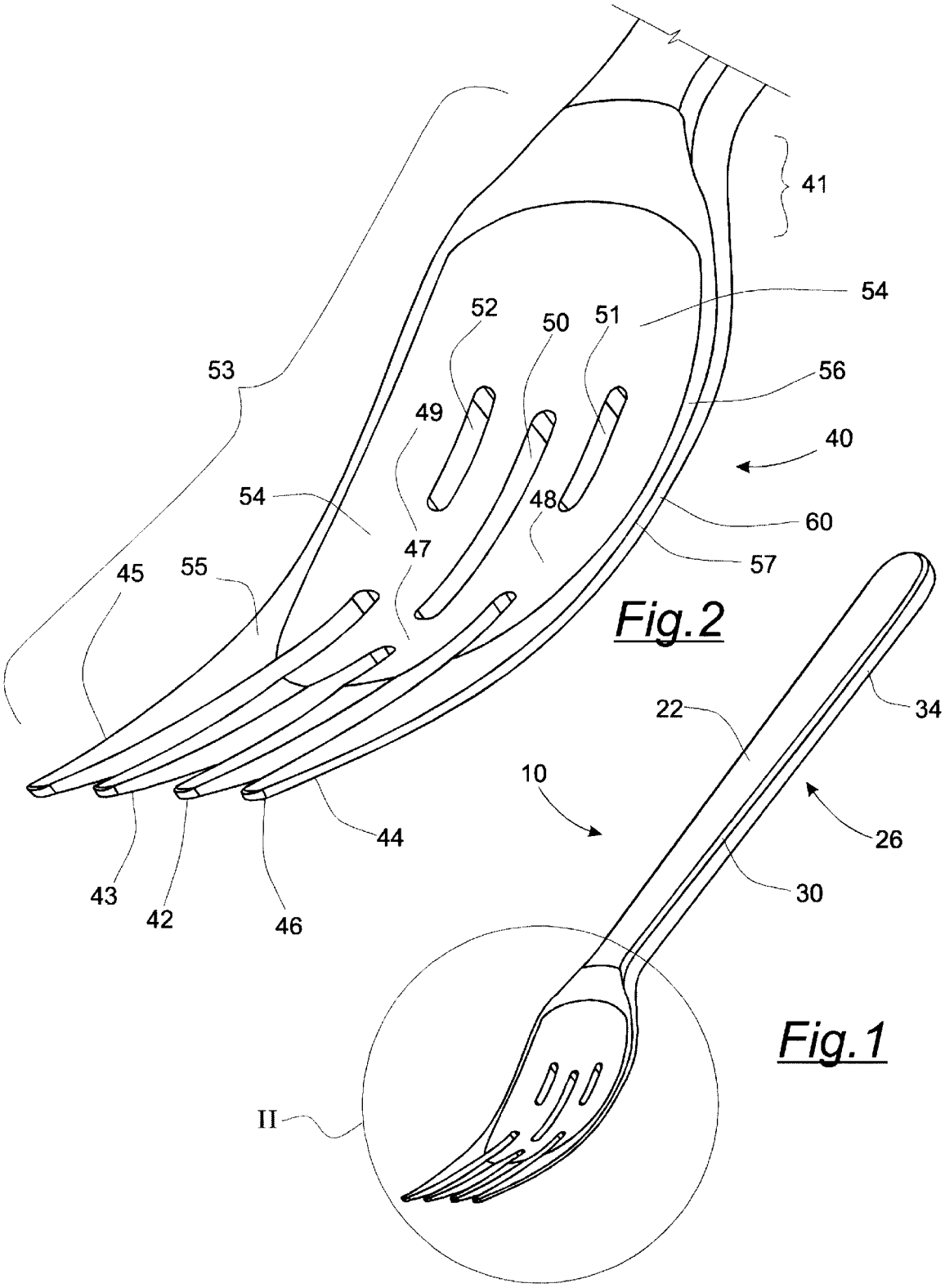
FIG. 1 is a perspective view of a version of the beveled edge fork of the invention.
FIG. 2 is an enlarged perspective view of the head of the beveled edge fork of FIG. 1.

OVERVIEW. Referring in particular to FIGS. 1 through 6, a beveled edge fork 10 constructed in accordance with the principles of the invention is seen. The beveled edge fork provides a handle 20 and a head portion 40. A preferred version of the head provides four tines extending from a base of the head portion which are strengthened by center, left and right reinforcements. A concave upper surface 54, enclosed by a U-shaped upper convex perimeter surface 55 mates with a lower beveled edge on a lower convex surface, forming left and right cutting edges, allowing a user to cut food with the side of the fork.

SLOTS. The center reinforcement 47, base 41 and left and right inner tines 42, 43 define a center slot 50 within the upper concave surface 54. Similarly, the left and right inner tines 42, 43, left and right outer tines 44, 45, base 41 and left and right side reinforcements 48, 49 define left and right side slots 51, 52. In a preferred version of the invention, the left and right slots are shorter than the center slot.

UPPER SURFACE. Referring particularly to FIG. 2, the upper surface 53 of the head 40 of the fork 10 includes an upper concave surface 54 partially enclosed within a generally U-shaped upper convex perimeter surface 55.

The upper concave surface 54 defines a somewhat spoon-like region within a middle portion of the head 40 of the fork. This spoon-like region is usable to support food which is difficult to spear with the tines, such as peas or similar small objects.

The upper convex perimeter surface 55 includes left and right upper beveled edges 56 which are adjacent to the lower beveled edge 60. The line separating the upper beveled edges 56 and lower beveled edges 60, defines left and right curved cutting edges 57. The curved cutting edge 57 allows the user to easily cut through many softer foods.

Figure 4:
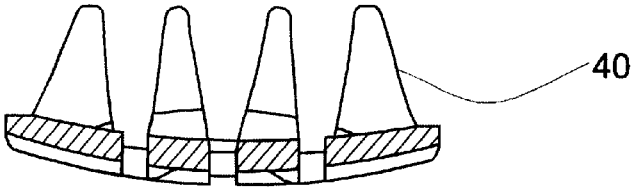
FIG. 4 is a cross-sectional view of the fork of FIG. 3, taken along the 4—4 lines.
Figure 3:
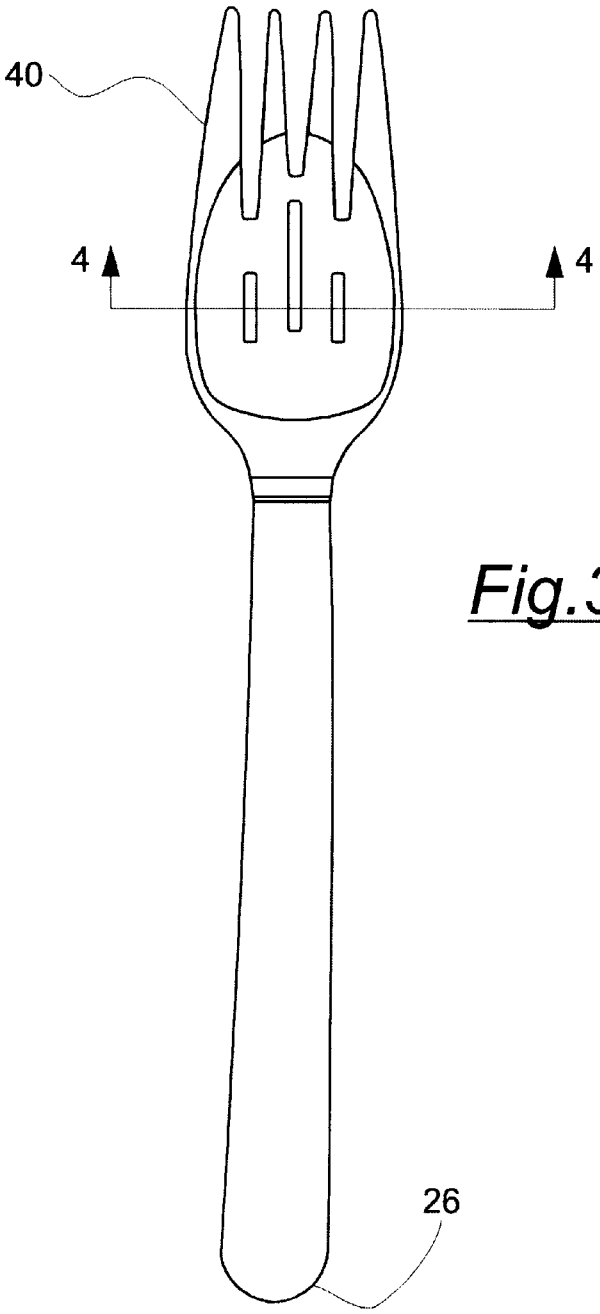
FIG. 3 is a top orthographic view of the fork of FIG. 1.
Figure 5:
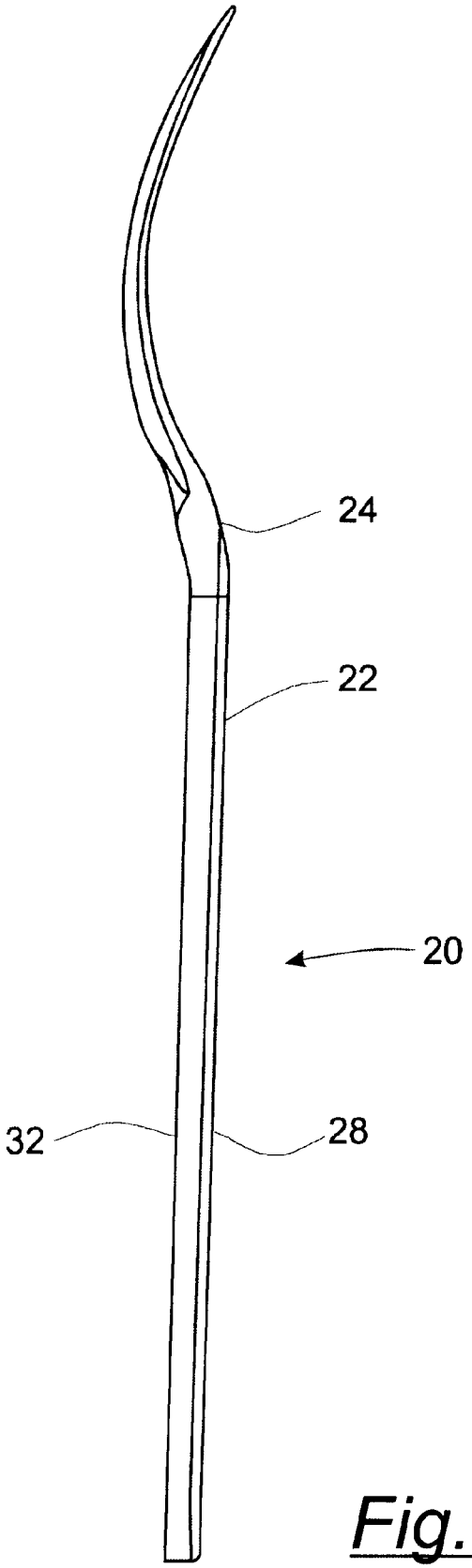
FIG. 5 is a side orthographic view of the fork of FIG. 1.
Figure 6:
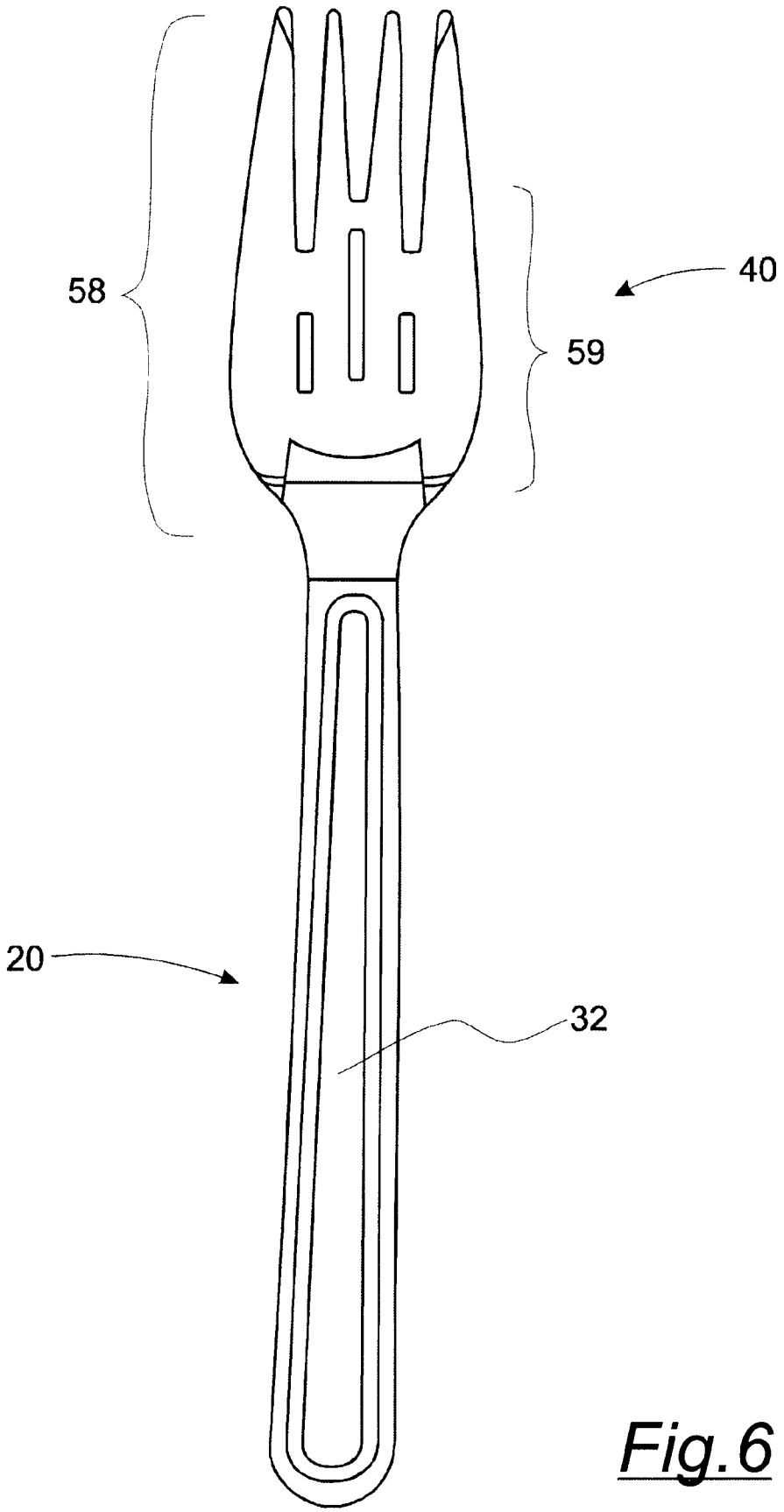
FIG. 6 is a bottom orthographic view of the fork of FIG. 1.

LOWER SURFACE. As seen in FIGS. 4, 5 and 6, a lower surface 58 includes a lower convex surface 59 having a perimeter defining a lower beveled edge 60.

USE. In use, the beveled edge fork 10 may be used as an ordinary fork to spear food. However, it can also be used in a manner similar to a knife in some instances, in which some foods can be cut by the curved cutting edge 57 which is defined by the intersection of the upper beveled edge 56 and the lower beveled edge 60. Additionally, the upper concave surface 54 can be used to carry and support food in a spoon-like manner.

ADVANTAGES. The previously described versions of the present invention have many advantages, including a primary advantage of providing a novel beveled edge fork having reinforcements between adjacent inner and outer tines, and between adjacent inner tines, thereby providing a more rigid support for the cutting edges defined at the intersection of the upper and lower beveled edges on the outer tines.

Another advantage of the present invention is to provide a beveled edge fork having an upper concave surface which allows better food-handling ability.

A still further advantage of the present invention is to provide an upper perimeter convex surface, adjacent to and surrounding the upper concave surface, which forms a cutting edge with the beveled edge of the lower surface.

The invention resides not in any one of these features per se, but rather in the particular combination of all of them herein disclosed and claimed, including particularly the upper surface 53 comprising an upper concave surface 54 and a U-shaped upper convex perimeter surface 55 combined with center, left and right reinforcements. The invention is therefore distinguished from the prior art in this particular combination of all of its structures for the functions specified.

Although the present invention has been described in considerable detail and with reference to certain preferred versions, other versions are possible. For example, while a preferred version of the invention provides four tines, an alternate version could provide three tines, made more rigid by left and right reinforcements. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect.

The invention is, therefore, claimed in any of its forms or modifications within the proper scope of the appended claims appropriately interpreted in accordance with the doctrine of equivalents.

| | | |
|---|---|---|
| 1 | 10 | beveled edge fork |
| 2 | 20 | handle |
| 3 | 40 | head |
| 4 | 20 | handle |
| 5 | 22 | body |
| 6 | 24 | curved transition |

-continued

| | | |
|---|---|---|
| 7 | 26 | rounded end |
| 8 | 28 | upper surface |
| 9 | 30 | beveled upper edge |
| 10 | 32 | contoured lower surface |
| 11 | 34 | edge surface |
| 12 | 40 | head |
| 13 | 41 | base |
| 14 | 42 | left inner tine |
| 15 | 43 | right inner tine |
| 16 | 44 | left outer tine |
| 17 | 45 | right outer tine |
| 18 | 48 | tip of tine |
| 19 | 47 | center reinforcement |
| 20 | 48 | left side reinforcement |
| 21 | 49 | right side reinforcement |
| 22 | 50 | center slot |
| 23 | 51 | left side slot |
| 24 | 52 | right side slot |
| 25 | 53 | upper surface |
| 26 | 54 | upper concave surface |
| 27 | 55 | upper convex perimeter |
| 28 | surface | |
| 29 | 58 | upper beveled edge |
| 30 | 57 | curved cutting edge |
| 31 | 58 | lower surface |
| 32 | 59 | lower convex surface |
| 33 | 60 | lower beveled edge |
| 34 | | |

What is claimed is:

1. A beveled edge fork, comprising:

(A) a handle, having a curved transition portion;

(B) a fork head portion, having an upper surface and a lower surface, the fork head portion additionally providing:

(a) a base, carried by the curved transition portion of handle;

(b) left and right outer tines, carried by the base;

(c) left and right inner tines, carried by the base;

(d) a center reinforcement, carried between the left and right inner tines, wherein the center reinforcement, the left and right inner tines and the base define a center slot;

(e) left and right side reinforcements, carried between the left outer tine and left inner tine and between the right outer tine and right inner tine, respectively, wherein the left and right inner and outer tines and base define left and right side slots;

(f) an upper concave surface, covering a middle portion of the upper surface of the fork head portion;

(g) an upper convex perimeter surface, adjacent to and surrounding the upper concave surface, wherein left and right side portions of the upper convex perimeter surface define left and right upper beveled edges;

(h) a lower convex surface, opposed to the upper concave surface, defining left and right lower beveled edges about its perimeter; and (i) left and right curved cutting edges, defined at the intersection of the left and right upper and lower beveled edges, respectively.

2. The improved fork as described in claim 1 wherein the position of the left and right reinforcement member creates an effective length of the left and right outer tines which is longer than the effective length of the narrower inner left and right tines with respect to the position of the central reinforcement member and the left and right reinforcement members.

* * * * *